US005772573A

United States Patent [19]

Hao

[11] Patent Number: 5,772,573

[45] Date of Patent: Jun. 30, 1998

[54] DECANTER CENTRIFUGE AND GEAR BOX WITH HARMONIC DRIVE AND ASSOCIATED OPERATING METHOD

[75] Inventor: Chi-Chung Hao, Orange, Conn.

[73] Assignee: Baker Hughes Incorporated, Houston, Tex.

[21] Appl. No.: 607,319

[22] Filed: Feb. 26, 1996

[51] Int. Cl.[6] ..... B04B 1/20; B04B 9/08; B04B 15/00

[52] U.S. Cl. ..... 494/15; 494/37; 494/53; 494/84; 74/640; 184/11.2; 184/31

[58] Field of Search ..... 494/15, 37, 50–55, 494/83, 84, 85; 74/640, 665 F, 665 K; 184/11.2, 13.1, 31

[56] References Cited

U.S. PATENT DOCUMENTS

| | | | |
|---|---|---|---|
| 3,161,081 | 12/1964 | Musser | 74/640 |
| 3,315,882 | 4/1967 | Reed | 494/15 |
| 3,407,902 | 10/1968 | Musser | 184/31 X |
| 3,419,211 | 12/1968 | Yasuda et al. | 494/84 X |
| 3,487,722 | 1/1970 | Cline | 74/640 |
| 3,635,311 | 1/1972 | Kaufman | 184/11.2 |
| 3,842,770 | 10/1974 | Nelson | 74/640 |
| 5,123,300 | 6/1992 | Himmelein et al. | 74/640 |
| 5,558,180 | 9/1996 | Yanigisawa | 184/31 X |

FOREIGN PATENT DOCUMENTS

| | | | |
|---|---|---|---|
| 1386448 | 12/1965 | France | 184/31 |

*Primary Examiner*—Charles E. Cooley
*Attorney, Agent, or Firm*—R. Neil Sudol; Henry D. Coleman

[57] ABSTRACT

A decanter centrifuge assembly comprises a bowl, a screw conveyor disposed inside the bowl for rotation at a speed different from an angular velocity of the bowl, and a harmonic drive unit including a circular spline drivingly connected to the conveyor. The harmonic drive unit further includes a flexible spline drivingly connected to the bowl and a wave generator disposed in contact with the flexible spline for distorting the flexible spline and enabling a driving of the flexible spline at a rate of rotation incrementally differing from a rate of rotation of the circular spline. The flexible spline has teeth partially meshing with teeth on the circular spline. The harmonic drive additionally has a lubrication system with a skimmer tube for paring lubricating fluid from a pool in an outer casing of the harmonic drive. A shaft coupled to the wave generator has a channel communicating with the skimmer tube. Several spray nozzles communicate with the channel in the shaft and are juxtaposed to respective bearing surfaces of the harmonic drive unit for spraying lubricating fluid onto the respective bearing surfaces.

20 Claims, 2 Drawing Sheets

DECANTER CENTRIFUGE AND GEAR BOX WITH HARMONIC DRIVE AND ASSOCIATED OPERATING METHOD

BACKGROUND OF THE INVENTION

This invention relates to a decanter centrifuge. In addition, this invention relates to a gear box for a decanter centrifuge. This invention also relates to an associated method for operating a decanter centrifuge.

A decanter centrifuge generally includes an outer bowl, an inner hub carrying a worm conveyor, a feed arrangement for slurry to be processed, and discharge ports for cake solids and clarified liquid. The bowl includes a cylindrical section and a conical beach section. The bowl and the hub are rotated at high, slightly different angular speeds so that heavier solid particles of a slurry introduced into the bowl are forced by centrifugation into a layer along the inner surface thereof. By differential rotation of the worm conveyor and the bowl, the sediment is pushed or scrolled to a cake discharge opening at the smaller, conical end of the bowl. Additional discharge openings are provided in the bowl, usually at an end opposite of the conical section for discharging a liquid phase separated from the solid particles in the centrifuge apparatus.

As discussed in U.S. Pat. No. 3,482,770, a so-called harmonic drive may be used to differentially drive the bowl and the conveyor of a decanter centrifuge. As disclosed in that patent, a harmonic drive includes a circular spline, a flexible spline and a wave generator component. The circular spline and the flexible spline are drivingly coupled to the bowl and the conveyor, respectively, while the strain inducing element (the wave generator) is held stationary. The conveyor screw is driven in the same direction as the centrifugal rotor and the centrifuge bowl but at a speed greater than that of the rotor and the bowl by a relatively small increment which is dependent on the gear reduction ratio of the harmonic drive. The speed differential increment decreases if the wave generator is driven in the same direction of rotation as the circular spline. Conversely, the speed differential increment increases if the wave generator is driven in the opposite direction to the rotation of the circular spline.

Some centrifuges operate with the conveyor rotating at a higher angular velocity than the bowl. In the other centrifuges, the opposite is true. These centrifuges are conventionally driven with planetary gear boxes. With such a power transmission, at least two stages of speed reduction are needed in order to achieve the desired speed ratio between the bowl and the conveyor. However, a problem arises since the size of a planetary gear box is proportional to the number of speed changing stages and since centrifuge gear boxes are commonly held by cantilevered supports. When the weight of an overhanging gear box attains a certain level, it has a natural vibration frequency which is close to the centrifuge operating speed. Thus, resonant destabilization occurs.

Planetary gear boxes have a natural limitation on their output speeds, owing to a limitation in cooling of the bearings. The problem here is to provide a more effective lubrication system to enable higher rotation speeds.

SUMMARY OF THE INVENTION

A decanter centrifuge assembly comprises, in accordance with the present invention, a bowl, a screw conveyor disposed inside the bowl for rotation at a speed different from an angular velocity of the bowl, and a harmonic drive unit including a circular spline drivingly connected to the conveyor. The harmonic drive unit further includes a flexible spline drivingly connected to the bowl and a wave generator disposed in contact with the flexible spline for distorting the flexible spline and enabling a transmission of rotary power between the flexible spline and the circular spline so that the circular spline rotates at an angular velocity which incrementally differs from a rate of rotation of the flexible spline. The flexible spline is rotatably coupled to the circular spline, for example, via intermeshing teeth on the two splines.

In accordance with another feature of the present invention, the harmonic drive has a lubrication system with a skimmer tube for paring lubricating fluid from a pool in an outer casing of the harmonic drive. A shaft coupled to the wave generator has a channel communicating with the skimmer tube. The lubricating system is further provided with a plurality of spray nozzles communicating with the channel in the shaft and juxtaposed to respective bearing surfaces of the harmonic drive unit for spraying lubricating fluid onto the respective bearing surfaces.

Preferably, the shaft extends along a longitudinal axis of the harmonic drive unit, the channel being coaxial with the rotation axis of the circular spline and the flexible spline. The shaft may be stationary or driven in one direction or another to fine tune the rotation speed of the flexible spline, i.e., to fine tune the speed differential between the centrifuge bowl and the conveyor.

In accordance with the present invention as described above, a gear box for a decanter centrifuge assembly having a bowl and a screw conveyor disposed inside the bowl for rotation at a speed different from an angular velocity of the bowl comprises a rigid circular spline, a first connector coupling the circular spline to the conveyor of the centrifuge assembly, a flexible spline rotatably coupled to the circular spline, a second connector coupling the flexible spline to the bowl of the centrifuge assembly, and a wave generator disposed in contact with the flexible spline for distorting the flexible spline and enabling a transmission of rotary power between the flexible spline and the circular spline so that the circular spline rotates at an angular velocity which incrementally differs from an angular velocity of the flexible spline. The gear box may have a lubrication system as discussed above.

The present invention is also directed to a method for operating a decanter centrifuge assembly having a bowl and a screw conveyor disposed inside the bowl for rotation at a speed different from an angular velocity of the bowl. The method comprises rotating the bowl of the centrifuge assembly at a first predetermined angular velocity, transmitting rotary power from the bowl to a flexible spline of a harmonic drive unit so that the flexible spline rotates about a rotation axis at the first predetermined angular velocity, rotating a circular spline of the harmonic drive unit about the rotation axis at a second predetermined angular velocity differing incrementally from the first predetermined angular velocity, and transmitting rotary force from the circular spline to the conveyor of the centrifuge assembly to rotate the conveyor at the second predetermined angular velocity.

It is to be understood that the second predetermined velocity, i.e., the rotation speed of the circular spline and the conveyor of the centrifuge assembly, is determined in part by the gear ratio between the flexible spline and the circular spline and in part by the rotary input to the wave generator. The rotary input to the wave generator may be zero (fixed wave generator) or positive or negative (rotation in one direction or the other).

Pursuant to another feature of the invention, the method further comprises paring lubricating fluid from a pool in an outer casing of the harmonic drive unit, guiding the pared lubricating fluid through a channel in a shaft extending coaxially to the rotation axis, and ejecting the pared lubricating fluid onto bearing surfaces of the harmonic drive unit from a plurality of spray nozzles communicating with the channel. Generally, the shaft is maintained stationary or driven in one direction or another to provide a desired speed differential between the centrifuge bowl and the conveyor.

Other methods of using a harmonic drive gear box in accordance with the present invention may be feasible. For example, such an alternative method might comprise rotating a circular spline of a harmonic drive unit about a rotation axis at a first predetermined angular velocity, transmitting rotary force from the circular spline to the conveyor of the centrifuge assembly to rotate the conveyor at the first predetermined angular velocity, maintaining a wave generator component of the harmonic drive unit stationary during rotating of the circular spline, rotating a flexible spline of the harmonic drive about the rotation axis at a second predetermined angular velocity differing incrementally from the first predetermined angular velocity, and transmitting rotary force from the flexible spline to the bowl of the centrifuge assembly to rotate the bowl at the second predetermined angular velocity.

Providing a decanter centrifuge with a harmonic gear drive as described herein enables rotation of the bowl and the conveyor at higher velocities. The smaller size of the drive relative to planetary gear boxes eliminates the vibration problem alluded to above. In addition, the internal oil jet lubrication system in accordance with the present invention is more efficient than the oil sump of conventional planetary gear boxes in controlling heat production in the gear box bearings.

A harmonic drive unit enables a variation in the differential speeds of the bowl and the conveyor by replacing the splines with another pair of splines having a different gear ratio. Thus, it is not necessary to provide a motor for driving the wave generator. The replacement of splines to achieve a new speed differential thus provides economies not available with planetary gear boxes, where a motor and a variable frequency drive are necessary for backdriving the sun gear or pinion to change a rotation speed differential in the field.

Lastly, a harmonic gear unit is less expensive than a planetary gear drive of the same level.

DETAILED DESCRIPTION

Figure 1:
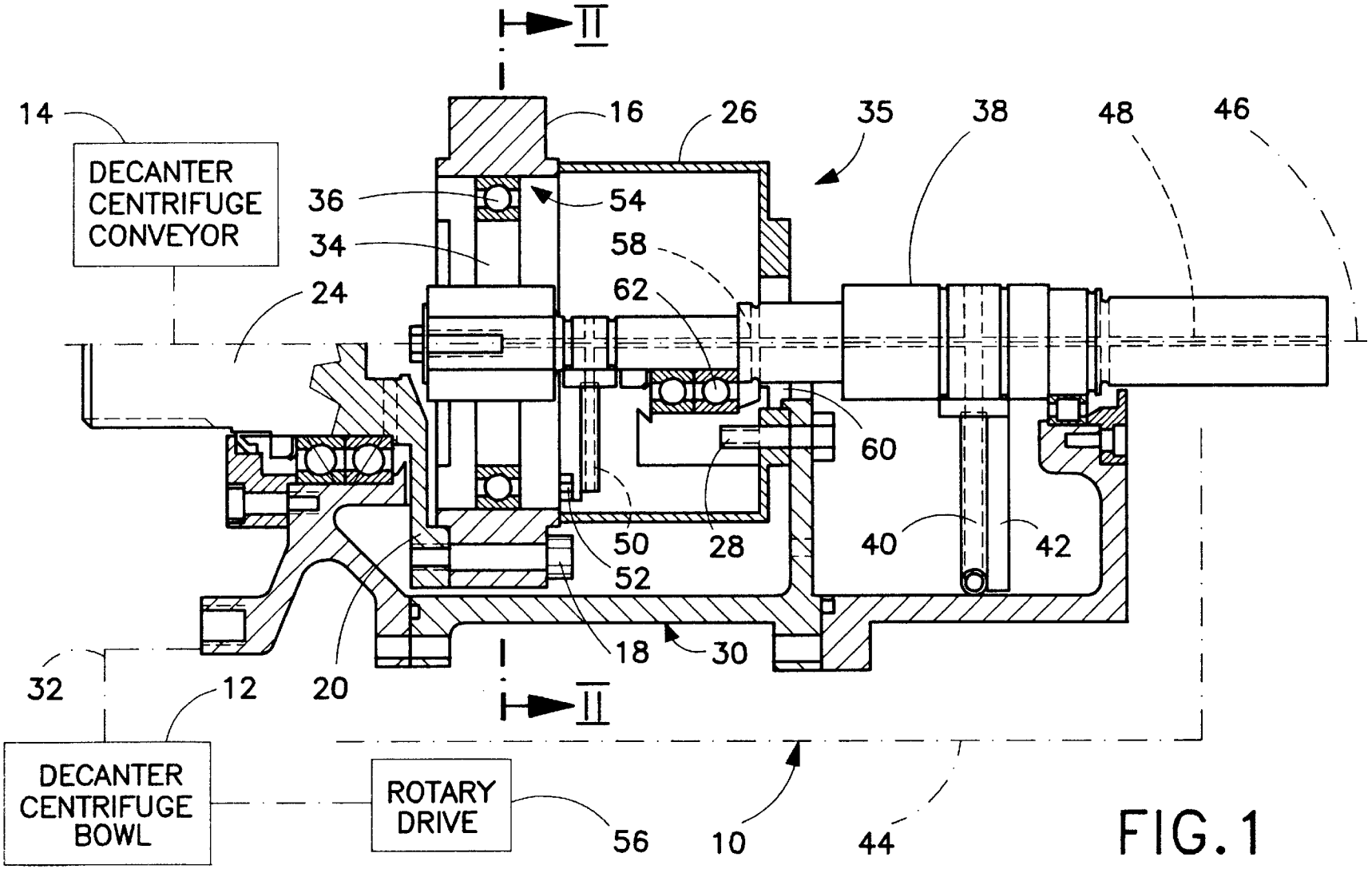
FIG. 1 is a schematic partial longitudinal cross-section view of a gear box of a decanter centrifuge assembly in accordance with the present invention.
Figure 2:
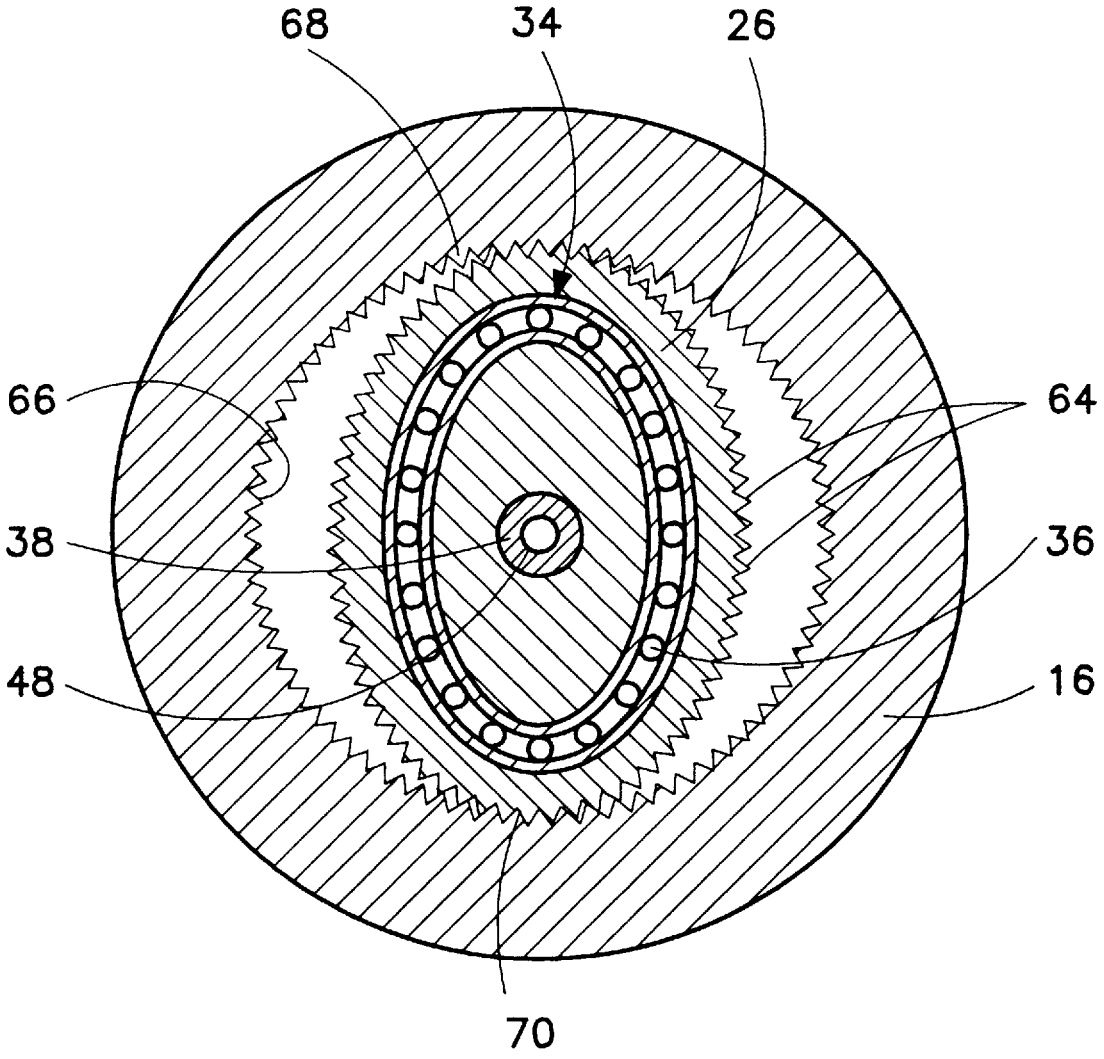
FIG. 2 is a schematic cross-sectional view taken along line II—II in FIG. 1.

The drawing shows a gear box 10 for a decanter centrifuge assembly having a bowl 12 and a screw conveyor 14 disposed inside the bowl for rotation at a speed different from an angular velocity of the bowl. Gear box 10 includes a rigid circular spline 16 drivingly connected to conveyor 14 via at least one bolt 18 and flange 20 of a drive shaft 24 of conveyor 14. Gear box 10 further comprises a flexible spline 26 which is partially inserted inside circular spline 16. Flexible spline 26 is provided with a ring of outwardly oriented teeth 64 (FIG. 2) which partially mesh with inwardly facing teeth 66 on circular spline 16. Flexible spline 26 is bolted at 28 to a force-transmitting assembly 30 in turn drivingly or drivably connected to centrifuge bowl 12, as indicated at 32.

Gear box 10 additionally includes a wave generator 34 disposed inside flexible spline 26 in contact therewith for distorting the flexible spline and enabling a transmission of rotary power between the flexible spline and circular spline 16 so that the circular spline rotates at an angular velocity which incrementally differs from a rate of rotation of the flexible spline. Wave generator 34 is an elliptical member with ball bearings 36 and operates to maintain diametrically opposed teeth 68 and 70 of flexible spline 26 in contact with teeth (not separately designated) on circular spline 16. Other teeth 66 and 64 of splines 16 and 26 are spaced from one another, and thus out of a driving relationship. Circular spline 16, flexible spline 26 and wave generator 34 are conventional components of a harmonic drive assembly 35 which has two drive outputs and two drive inputs.

In one method of operating gear box 10 in conjunction with bowl 12 and conveyor 14, bowl 12 is rotated by a rotary drive 56 at a first predetermined angular velocity. Rotary force is transmitted from bowl 12 to flexible spline 26 via force-transmitting assembly 30 to rotate the flexible spline about a rotation axis 46. Under the action of wave generator 34, rotary power is transmitted from flexible spline 26 to circular spline 16 so that the circular spline rotates at a second predetermined angular velocity which differs incrementally from the angular velocity of bowl 12 and flexible spline 26. A shaft 38 coupled to wave generator 34 may be fixed to hold the wave generator stationary. The difference in rotation speed or angular velocity of circular spline 16 and flexible spline 26 is determined by the reduction ratio. However, it is to be noted that shaft 38 and concomitantly wave generator 34 may be driven in one direction or another to fine tune the rotation speed of circular spline 16 relative to flexible spline 26 and to provide a desired speed differential between conveyor 14 and centrifuge bowl 12.

Gear box 10 is provided with a lubrication system which includes a skimmer tube 40 supported on shaft 38 via a bracket 42. Skimmer tube 40 pares lubricating fluid from a pool (not shown) in an outer casing 44 of gear box 10. Shaft 38 is coaxially disposed about rotation axis 46 of circular spline 16 and flexible spline 26 and has a longitudinally extending channel 48 communicating with skimmer tube 40. Channel 48 is also coaxial with axis 46. A plurality of generally radially oriented ancillary channels 50 extend from longitudinal channel 48 to respective spray nozzles 52 disposed in juxtaposition to bearing surfaces 54. Spray nozzles 52 thus communicate with skimmer tube 40 via longitudinal channel 48.

During operation of the decanter centrifuge assembly, lubricating fluid is pared or skimmed from a pool in outer casing 44 of gear box 10. The pared lubricating fluid is guided through channels 48 and 50 and then ejected onto bearing surfaces 54 of harmonic drive 35. Other radially extending fluid guide channels 58 are connected to spray nozzles 60 juxtaposed to bearings 62.

Although the invention has been described in terms of particular embodiments and applications, one of ordinary skill in the art, in light of this teaching, can generate additional embodiments and modifications without departing from the spirit of or exceeding the scope of the claimed invention. For example, rotary power transmission may extend along a path from circular spline, over flexible spline 26 and force-transmitting assembly 30 to bowl 12. Accordingly, it is to be understood that the drawings and descriptions herein are proffered by way of example to facilitate comprehension of the invention and should not be construed to limit the scope thereof.

What is claimed is:

1. A decanter centrifuge assembly, comprising:

a bowl;

a screw conveyor disposed inside said bowl for rotation at a speed different from an angular velocity of said bowl; and a harmonic drive unit including a circular spline drivingly connected to said conveyor via a force transmission coupling extending from one side of said harmonic drive unit, a flexible spline drivingly connected to said bowl via a force transmission coupling extending from an opposite side of said harmonic drive unit, and a wave generator disposed in contact with said flexible spline for distorting said flexible spline and enabling a transmission of rotary power between said flexible spline and said circular spline so that said flexible spline rotates at an angular velocity incrementally differing from an angular velocity of said circular spline, said flexible spline being rotatably coupled to said circular spline.

2. The centrifuge assembly defined in claim 1 wherein said harmonic drive unit includes an outer casing and a shaft coupled to said wave generator, said harmonic drive unit further including a plurality of bearing surfaces, said harmonic drive unit having a lubrication system with a skimmer tube for paring lubricating fluid from a pool in said outer casing, said shaft having a channel communicating with said skimmer tube, said lubrication system having a plurality of spray nozzles communicating with said channel and juxtaposed to respective ones of said bearing surfaces for spraying lubricating fluid onto the respective bearing surfaces.

3. The centrifuge assembly defined in claim 2 wherein said shaft extends along a longitudinal axis of said harmonic drive unit, said channel being coaxial with said axis.

4. The centrifuge assembly defined in claim 1 wherein said harmonic drive unit includes a fixation component connected to said wave generator for holding said wave generator stationary during rotation of said circular spline and said flexible spline.

5. The centrifuge assembly defined in claim 4 wherein said fixation component is a shaft extending coaxially along an axis of rotation of said circular spline and said flexible spline.

6. The centrifuge assembly defined in claim 1, further comprising a rotary drive operatively coupled to said bowl for rotating same, said bowl being connected to said flexible spline to transmit rotary power thereto, said flexible spline being rotatively coupled to said circular spline for transmitting rotary power thereto, said circular spline driving said conveyor.

7. The centrifuge assembly defined in claim 1 wherein said conveyor and said bowl are located on said one side of said harmonic drive unit.

8. A gear box for a decanter centrifuge assembly having a bowl and a screw conveyor disposed inside said bowl for rotation at a speed different from an angular velocity of said bowl, comprising:

a rigid circular spline;

a first connector coupling said circular spline to the conveyor of the centrifuge assembly;

a flexible spline rotatably coupled to said circular spline;

a second connector coupling said flexible spline to the bowl of the centrifuge assembly; and a wave generator disposed in contact with said flexible spline for distorting said flexible spline and enabling a transmission of rotary power between said flexible spline and said circular spline so that said flexible spline rotates at an angular velocity incrementally differing from an angular velocity of said circular spline, said first connector extending to said circular spline from one side of said wave generator said second connector extending to said flexible spline from an opposite side of said wave generator.

9. The gear box defined in claim 8, further comprising an outer casing, a plurality of bearing surfaces and a shaft disposed at least partially in said casing and coupled to said wave generator, also comprising a lubrication system with a skimmer tube for paring lubricating fluid from a pool in said outer casing, said shaft having a channel communicating with said skimmer tube, said lubrication system having a plurality of spray nozzles communicating with said channel and juxtaposed to respective ones of said bearing surfaces for spraying lubricating fluid onto said bearing surfaces.

10. The gear box defined in claim 9 wherein the gear box has a longitudinal axis, said shaft extending along said longitudinal axis, said channel being coaxial with said axis.

11. The gear box defined in claim 8, further comprising a fixation component connected to said wave generator for holding said wave generator stationary during rotation of said circular spline and said flexible spline.

12. The gear box defined in claim 11 wherein said fixation component is a shaft extending coaxially along an axis of rotation of said circular spline and said flexible spline.

13. The gear box defined in claim 8 wherein said first connector drivingly couples said circular spline to said conveyor to enable transmission of rotary power from said circular spline to said conveyor, said second connector drivingly couples said bowl to said flexible spline to enable transmission of rotary power from said bowl to said flexible spline.

14. A method for operating a decanter centrifuge assembly having a bowl and a screw conveyor disposed inside said bowl for rotation at a speed different from an angular velocity of said bowl, comprising:

rotating the bowl of the centrifuge assembley at a first predetermined angular velocity;

transmitting rotary power from the bowl to a flexible spline of a harmonic drive unit via a transmission coupling extending to a first side of said harmonic drive unit, so that said flexible spline rotates about a rotation axis at said first predetermined angular velocity;

rotating a circular spline of said harmonic drive unit about said rotation axis at a second predetermined angular velocity differing incrementally from said first predetermined angular velocity;

distorting said flexible spline via a wave generator disposed in contact with said flexible spline, to place said flexible spline in contact with said circular spline and thereby enable a transmission of rotary power between said flexible spline and said circular spline; and transmitting rotary force from said circular spline to the conveyor of the centrifuge assembly via a transmission coupling extending to a second side of said harmonic drive unit opposite said first side, to rotate said conveyor at said second predetermined angular velocity.

15. The method defined in claim 14, further comprising:

paring lubricating fluid from a pool in an outer casing of said harmonic drive unit;

guiding the pared lubricating fluid through a channel in a shaft, said channel extending coaxially to said rotation axis; and ejecting the pared lubricating fluid onto bearing surfaces of said harmonic drive unit from a plurality of spray nozzles communicating with said channel.

16. The method defined in claim 15 wherein said shaft is coupled to said wave generator disposed in contact with said flexible spline for distorting said flexible spline and enabling driving of said flexible spline at said first predetermined angular velocity, said flexible spline having teeth partially meshing with teeth on said circular spline.

17. The method defined in claim 16, further comprising maintaining said shaft and said wave generator stationary during rotating of said circular spline.

18. A decanter centrifuge assembly, comprising:

a bowl;

a screw conveyor disposed inside said bowl for rotation at a speed different from an angular velocity of said bowl; and a harmonic drive unit operatively connected to said conveyor and said bowl, said harmonic drive unit including a wave generator, an outer casing and a shaft coupled to said wave generator and extending along a longitudinal axis of said harmonic drive unit, siad harmonic drive unit having a lubrication system with a skimmer tube for paring lubricating fluid from a pool in said outer casing, said shaft having a channel coaxial with said axis and communicating with said skimmer tube, said lubricating system having at least one spray nozzle communication with said channel and juxtaposed to a bearing surface of said harmonic drive unit for spraying lubricating fluid onto the bearing surface.

19. The centrifuge assembly defined in claim 18 wherein said harmonic drive unit includes a circular spline and a flexible spline, said flexible spline being in contact with said wave generator, further comprising a rotary drive operatively coupled to said bowl for rotating same, said bowl being connected to said flexible spline to transmit rotary power thereto, said flexible spline being rotatively coupled to said circular spline for transmitting rotary power thereto, said circular spline driving said conveyor.

20. A gear box for a decanter centrifuge assembly having a bowl and a screw conveyor disposed inside said bowl for rotation at a speed different from an angular velocity of said bowl, comprising:

a rigid circular spline;

a first connector coupling said circular spline to the conveyor of the centrifuge assembly;

a flexible spline rotatably coupled to said circular spline;

a second connector coupling said flexible spline to the bowl of the centrifuge assembly;

a wave generator disposed in contact with said flexible spline for distorting said flexible spline and enabling a transmission of rotary power between said flexible spline and said circular spline so that said flexible spline rotates at an angular velocity incrementally differing from an angular velocity of said circular spline;

an outer casing;

a shaft coupled to said wave generator, said shaft extending along a longitudinal axis of said gear box and having a channel coaxial with said axis; and a lubrication system with a skimmer tube for paring lubricating fluid from a pool in said outer casing, said channel communicating with said skimmer tube, said lubricating system having at least one spray nozzle communicating with said channel and juxtaposed to a bearing surface of said gear box for spraying lubricating fluid onto the bearing surface.

* * * * *